US005992840A

United States Patent [19]

Meier

[11] Patent Number: 5,992,840

[45] Date of Patent: Nov. 30, 1999

[54] APPARATUS FOR PROCESSING SHEET-LIKE PRODUCTS

[75] Inventor: Jacques Meier, Baretswil, Switzerland

[73] Assignee: Ferag AG, Hinwill, Switzerland

[21] Appl. No.: 08/989,699

[22] Filed: Dec. 12, 1997

[30] Foreign Application Priority Data

Dec. 13, 1996 [CH] Switzerland ..... 3067/96

[51] Int. Cl.[6] ..... B65H 39/02

[52] U.S. Cl. ..... 270/58.29; 270/52.16

[58] Field of Search ..... 270/52.16, 52.29, 270/52.19, 58.29

[56] References Cited

U.S. PATENT DOCUMENTS

| | | | |
|---|---|---|---|
| 4,706,951 | 11/1987 | Leu . | |
| 5,007,627 | 4/1991 | Chandhoke . | |
| 5,662,319 | 9/1997 | Honegger . | |
| 5,727,781 | 3/1998 | Muller | 270/58.29 |
| 5,765,823 | 6/1998 | Meier et al. | 270/58.23 |

FOREIGN PATENT DOCUMENTS

| | | |
|---|---|---|
| 0 771 754 | 5/1997 | European Pat. Off. . |
| 663559 | 7/1936 | Germany . |

*Primary Examiner*—William E. Terrell
*Assistant Examiner*—Khoi H. Tran
*Attorney, Agent, or Firm*—Brinks Hofer Gilson & Lione

[57] ABSTRACT

An apparatus has a main conveyor and feed conveyors. The main conveyor is provided with elongate receiving elements that are arranged transversely with respect to their movement path. At feed locations, the circulatory paths of the feed conveyors run over the main conveyor. The feed conveyors have clamps that are spaced apart one behind the other and are driven in circulation in a feed direction. The clamps are adapted to feed the products to the receiving elements and to discharge them to these receiving elements at the feed locations. The clamps are arranged obliquely with respect to their circulatory path. As a result, a straight line running parallel to a clamp-mouth plane and a receiving-element plane, and perpendicular to a longitudinal direction of the clamp mouth, forms an acute angle with the circulatory path.

26 Claims, 5 Drawing Sheets

Fig.1
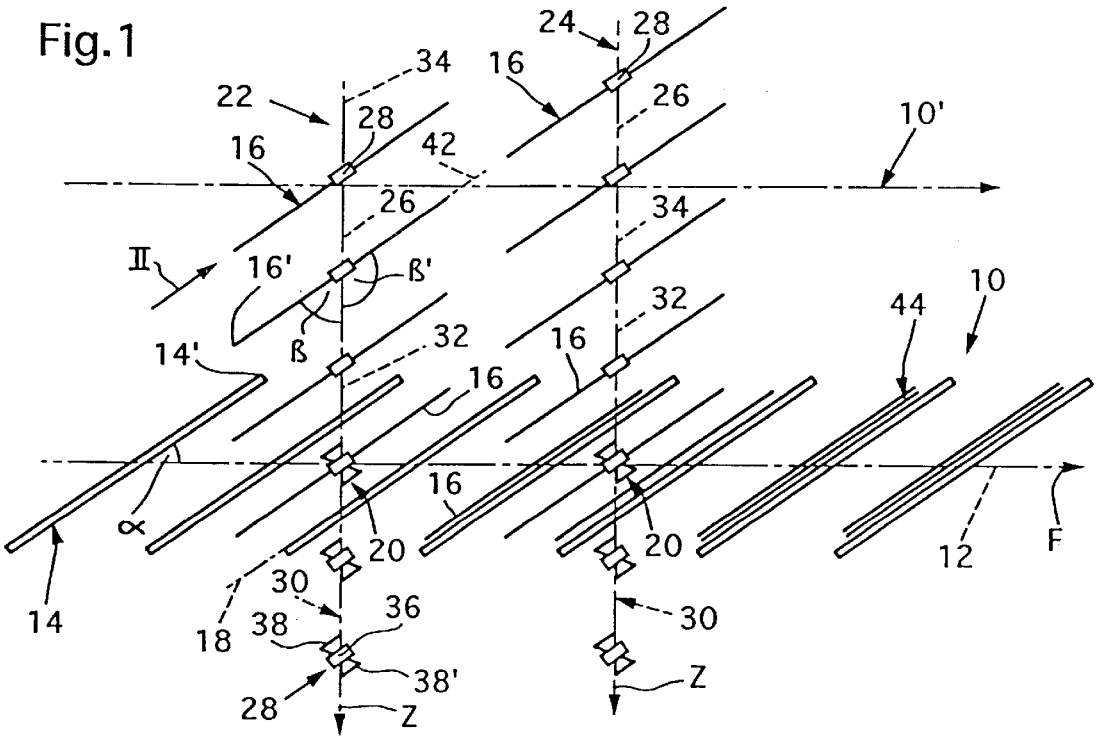
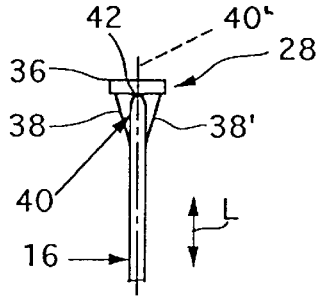
Fig.2
Fig.3
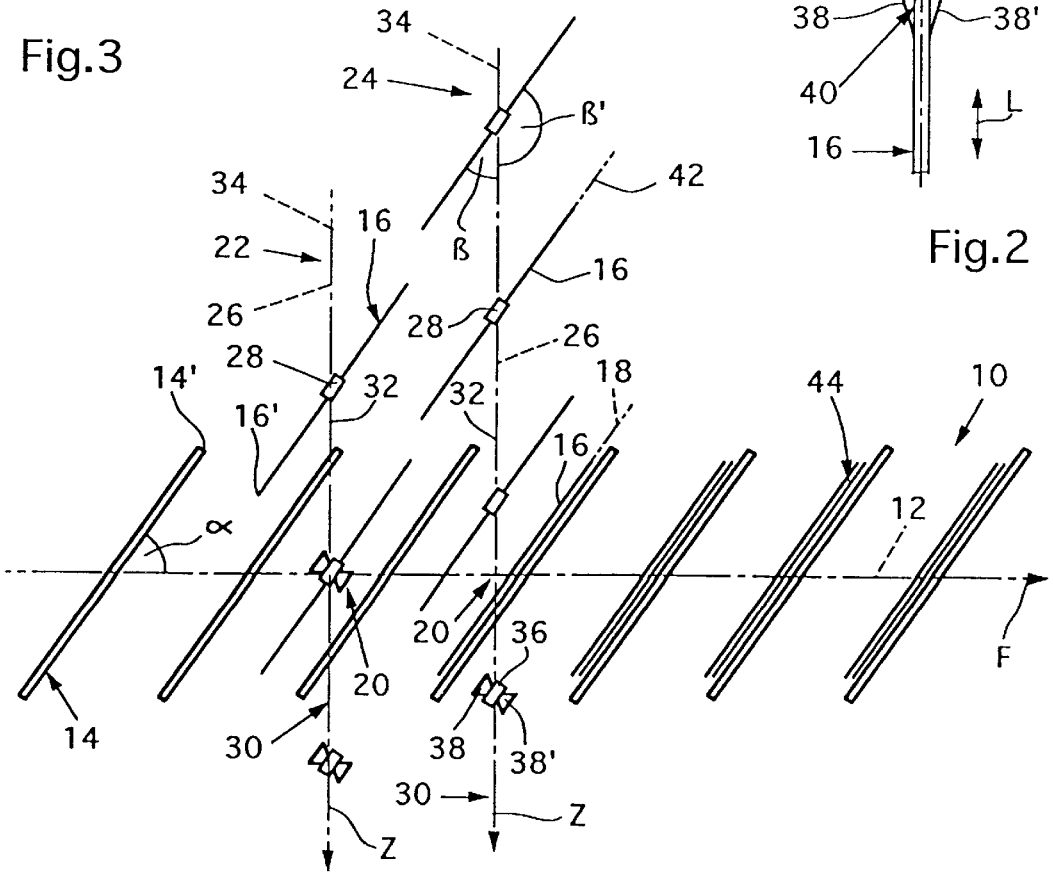

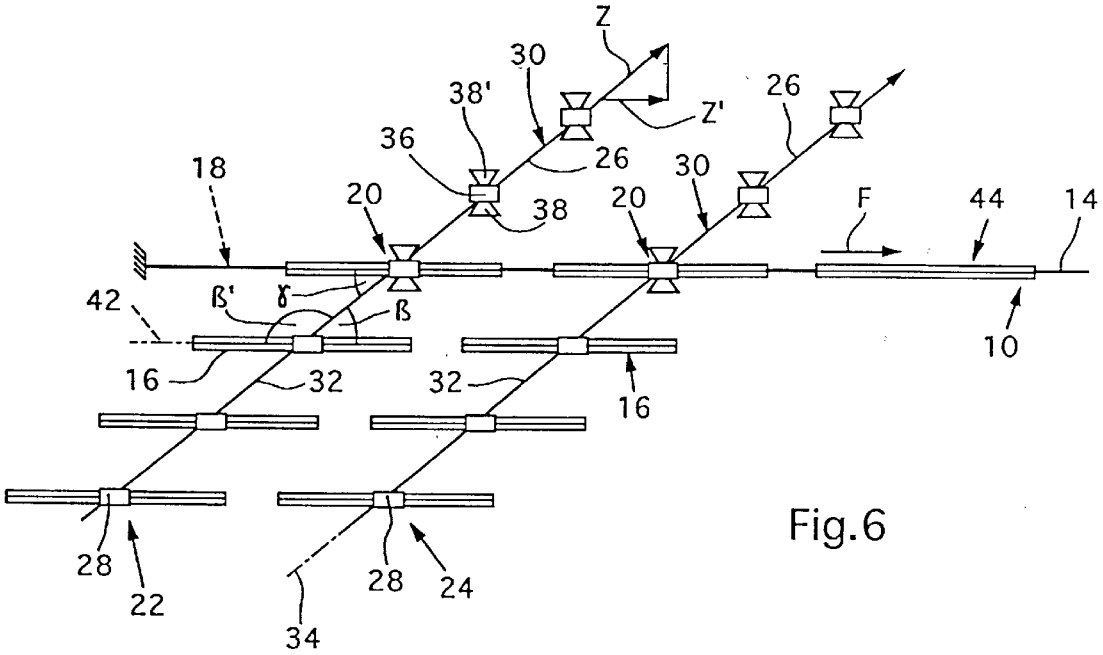
Fig.6
Fig.7
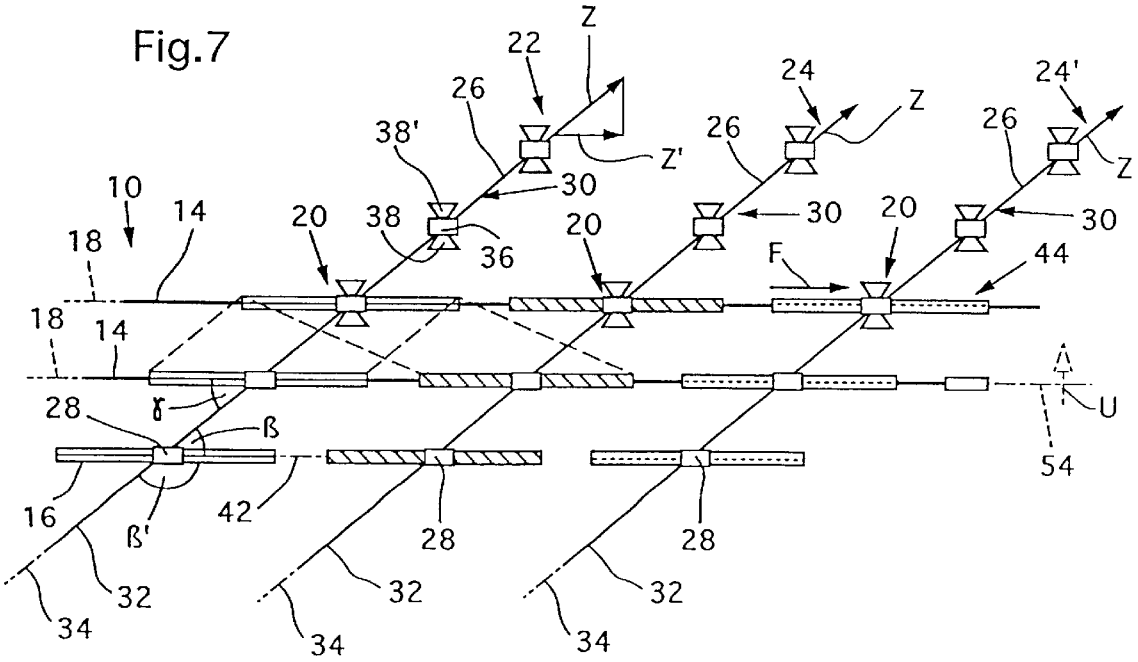

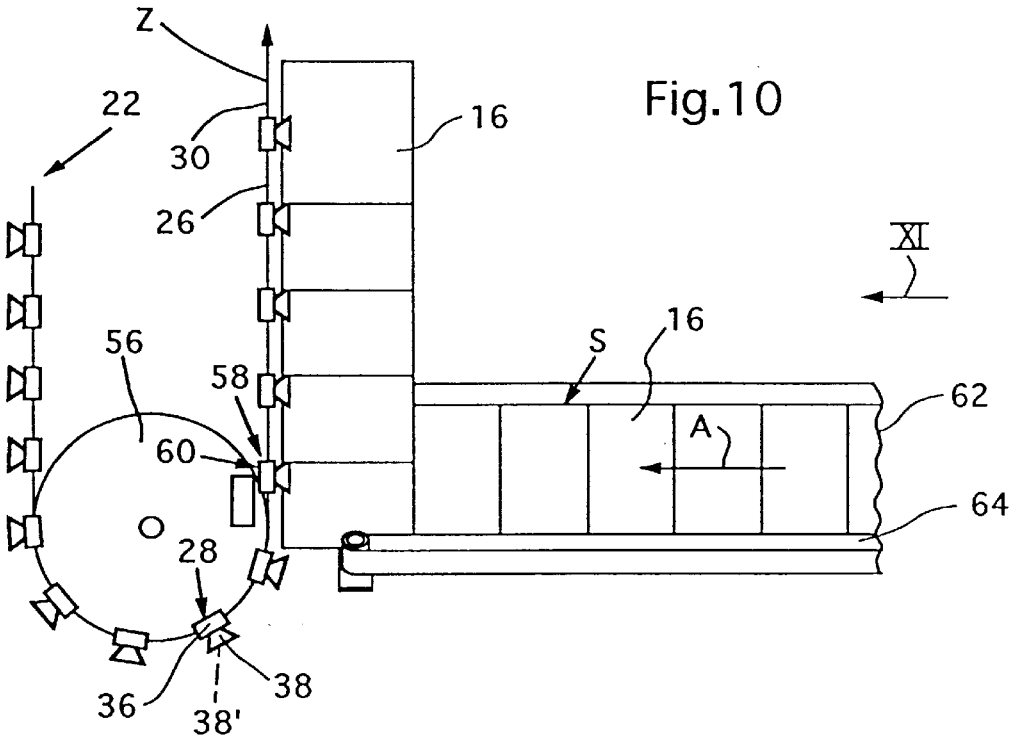
Fig.10
Fig.11
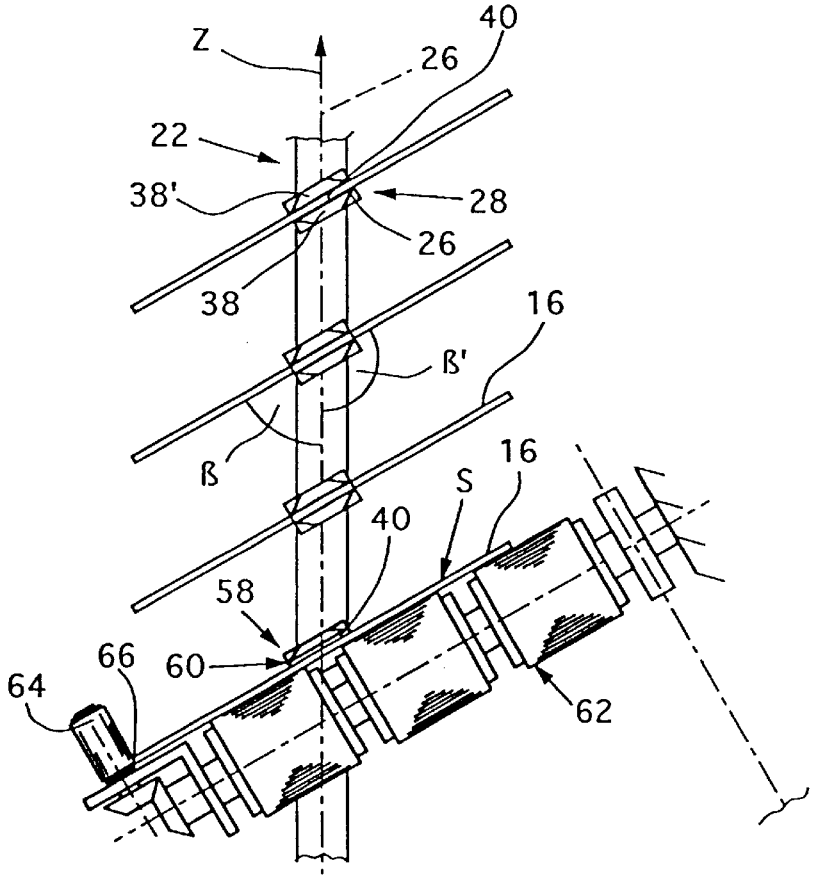

APPARATUS FOR PROCESSING SHEET-LIKE PRODUCTS

BACKGROUND OF THE INVENTION

The present invention relates to an apparatus for processing sheet-like products, in particular printed products.

An apparatus of this type is disclosed in U.S. patent application Ser. No. 08/741,259 (corresponding to EP-A-0 771 754), commonly assigned with the present application. It has a main conveyor that leads past a plurality of feed locations and has a circulating drawing member, on which elongated receiving elements are spaced apart one behind the other. These receiving elements are positioned obliquely with respect to their movement path. The circulatory path of each feed conveyor runs horizontally, in a rectilinear manner, over the main conveyor and past the feed locations. Each feed conveyor has individually controllable clamps that are spaced apart one behind the other on a circulating chain and are intended for transporting sheet-like products in a suspended state. When the clamps are open, the sheet-like products are transferred to the receiving elements of the main conveyor at the feed locations. The circulatory paths run in vertical planes that are perpendicular to the longitudinal direction of the receiving elements. The clamps are arranged perpendicular to the circulatory path, and thus parallel to the receiving elements. As a result, the products are fed to the receiving elements from the side.

It is an object of the present invention to provide an apparatus for processing sheet-like products, in particular printed products, that, while handling the products carefully, permits a high degree of flexibility in the arrangement and design of the main conveyor and the feed conveyors.

SUMMARY OF THE INVENTION

The present invention provides an apparatus for processing sheet-like products comprising at least one main conveyor that runs past a feed location. The main conveyor has an elongate receiving element to which a product can be fed at the feed location, and the receiving element defines a receiving-element plane for the product.

The apparatus of the present invention also comprises a feed conveyor with a plurality of individually controllable clamps that are arranged one behind the other. Each clamp has a clamp mouth defining a clamp-mouth plane. The clamps are moved in a feed direction along a continuous circulatory path running past the feed location to convey products up to the feed location and to discharge products at the feed location to the receiving element. The circulatory path has a selection arranged directly upstream of the feed location.

In the apparatus of the present invention, the clamps are arranged at the feed location and in the section of the circulatory path obliquely with respect to the circulatory path. As a result, the angle that is formed by the circulatory path and a straight line running parallel to the clamp-mouth plane, perpendicular to a longitudinal direction of the clamp mouth, and at least approximately parallel to the receiving-element plane, is respectively acute or obtuse.

BRIEF DESCRIPTION OF THE DRAWINGS

FIG. 1 shows a plan view of a rectilinear section of a preferred embodiment of a main conveyor of the apparatus of the present invention, with obliquely positioned receiving elements. Also shown are two feed conveyors of the present invention with obliquely positioned transporting clamps. At feed locations, the feed conveyors run over the main conveyor perpendicular to the conveying direction of the main conveyor as shown.

FIG. 2 shows a clamp of a feed conveyor shown in FIG. 1, in the direction of the arrow II.

FIG. 3 shows a plan view of a further embodiment of the apparatus of the present invention. In this embodiment, the movement path of the receiving elements of the main conveyor and the circulatory paths of the clamps of the feed conveyors run in the same manner as in the embodiment shown in FIG. 1, although the acute angle formed by the receiving elements and their movement path is larger and the acute angle formed by the clamps and their circulatory paths is smaller.

FIG. 6 shows in plan view an embodiment of the apparatus of the present invention having a receiving element that ends in the conveying direction of the main conveyor, and two feed-conveyor circulatory paths that, at feed locations, run over the receiving element with their clamps being aligned parallel to the receiving element.

FIG. 7 shows a plan view of an embodiment of the apparatus of the present invention having a plurality of parallel receiving elements that run in the conveying direction F of the main conveyor and are arranged so as to circulate around a common axis of rotation. This embodiment also has three feed conveyors that run obliquely over the axis of rotation and have clamps arranged parallel to the receiving elements.

FIG. 10 shows a view of a region of a feed conveyor of the apparatus of the present invention with obliquely positioned clamps receiving products that are fed by a belt conveyor.

FIG. 11 shows a side view, in the direction of the arrow XI of FIG. 10, of those regions of the feed conveyor and of the belt conveyor that are shown in FIG. 10.

DETAILED DESCRIPTION

Figure 8:
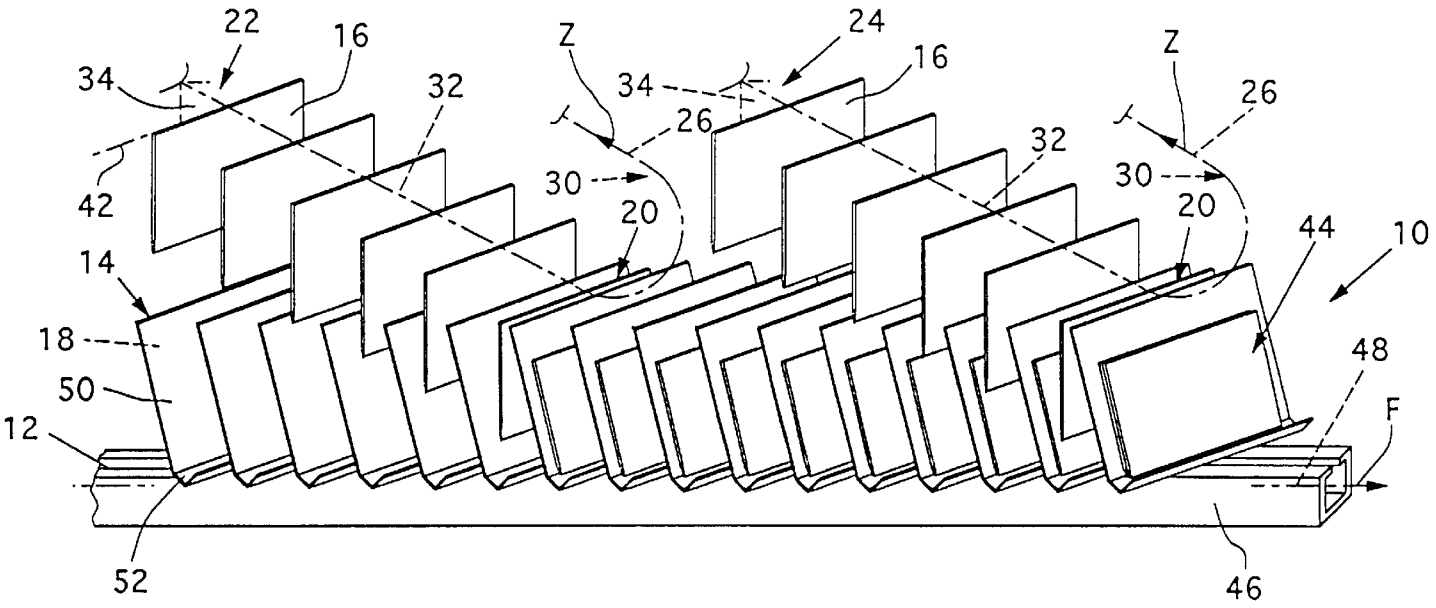
FIG. 8 shows a perspective view of a rectilinear section of a main conveyor of the apparatus of the present invention with L-shaped receiving elements and two feed conveyors that slope toward the feed locations and have clamps arranged obliquely with respect to their circulatory path.

FIG. 1 shows, in plan view, a simplified illustration of a region of a main conveyor 10 of a preferred embodiment of the present invention. The main conveyor 10 has a movement path 12 that is indicated by chain-dotted lines and is rectilinear in the region. Receiving elements 14 are driven continuously in circulation along the movement path 12, and are spaced apart one behind the other by a fixed distance in the conveying direction F. As shown in FIG. 1, the elongate receiving elements 14 are positioned obliquely with respect to the conveying direction F and form an acute angle α with the conveying direction F. As a result of this oblique positioning, one edge 14' of the receiving element 14 leads the other, as seen in the conveying direction F. For the purpose of collecting, collating or inserting products 16, the receiving elements 14 may be designed in a pocket-like manner or, as best shown in FIG. 8, in an L-shaped manner. It is also possible, however, for the purpose of collecting the products 16, to design the receiving elements 14 in a saddle-like manner. The receiving elements 14 establish a receiving-element plane 18 which, in the case of the receiving elements 14 being designed in a pocket-like or L-shaped manner, is defined by that wall against which the products 16 that have been fed to the receiving element 14 come to rest. In the case of the receiving elements 14 being designed in a saddle-like manner, the receiving-element plane is defined by the center plane running in the longitudinal direction.

The movement path 12 of the main conveyor 10 runs past two feed locations 20 that are spaced apart from one another in the conveying direction F. A feed conveyor 22 or 24 likewise runs past each of the feed locations 20. Each of the feed conveyors has clamps 28 that are spaced apart one behind the other at a fixed distance on a continuously driven, endless drawing member 26. The clamps 28 have a circulatory path 30 with a circulatory-path section 32 that is arranged directly upstream of the feed location in the feed direction Z. At the feed location 20, the circulatory path 30 runs above the main conveyor 10 and in a vertical plane 34 that is perpendicular to the conveying direction F. The distance between the main conveyor 10 and the feed conveyors 22, 24 at the transfer locations 20 is small. Preferably, it is smaller than the length, as measured in the vertical direction, of the products 16 that are to be fed in the suspended state by the clamps 28.

FIG. 2 shows one of the clamps 28 as seen in the direction of arrow 11 in FIG. 1. It has two clamping jaws 38, 38' that are arranged on a carrying element 36 which is connected to the drawing member 26. The clamping jaws can be moved from an open position into a closed position (shown in FIG. 2) and vice versa. The open position is indicated in FIG. 1 by the clamps 28 that are located at the transfer locations 20 and downstream thereof in the feed direction Z. The clamping jaws 38, 38' form a clamp mouth 40, the longitudinal direction of which is designated by the double arrow L. In the closed position of the clamping jaws 38, 38', the clamp mouth 40 defines a clamp-mouth plane 40'. The part of a product 16 that is retained by the clamp 28 and arranged in the clamp mouth 40 is located essentially in this clamp-mouth plane 40'. Reference numeral 42 designates a straight line that runs parallel to the clamp-mouth plane 40' and perpendicular to the longitudinal direction L.

As shown in FIG. 1, the clamps 28 are positioned obliquely with respect to their circulatory path 30, such that the straight line 42 and the circulatory path 30 form an acute angle β and an obtuse angle β' that is supplementary to the acute angle. Furthermore, the straight line 42 runs parallel to the receiving-element plane 18.

The distances between the receiving elements 14 and clamps 28, and the conveying speed of the main conveyor 10 and the feed rate of the feed conveyors 22, 24, are coordinated with one another such that a product 16 is introduced by each feed conveyor 22, 24 into each receiving element 14 from the side, in the manner of intermeshing, obliquely toothed racks. The product 16 is transferred as it passes the feed location 20 by virtue of the clamps 28 being opened. As a result, the individually fed products 16 are combined in the receiving elements 14 to form intermediate products or main products 44, which are removed from the receiving elements 14 downstream of the feed locations 20 for the purpose of further processing.

In order to ensure optimum introduction of the products 16 into the receiving elements 14 by the feed conveyors 22, 24, and optimum introduction of the forces acting on the products 16 (as the direction of the products changes after the clamps 28 have been opened), the feed direction Z is advantageously directed with respect to the conveying direction F. The leading edge 14' of the receiving elements 14 and the leading edge 16' of the products 16, with respect to the feed direction Z, are directed toward one another. The leading edge 16' of the products 16 follows behind with respect to the conveying direction F, the opposing trailing edge of the products 16.

For the sake of completeness, it should be mentioned that the circulatory-path section 32 may run horizontally or may slope in the feed direction Z.

The chain-dotted line designated by 10' in FIG. 1 indicates a second main conveyor, which runs parallel to and is of the same design as the main conveyor 10. The points at which the feed conveyors 22, 24 intersect the second main conveyor 10' likewise form feed locations at which the feed conveyors 22, 24 can each discharge one product to the receiving elements of the second main conveyor 10' in the manner described above. Products 16 that are not to be discharged to the second main conveyor 10' run past the corresponding receiving elements 14 and can then be discharged to the main conveyor 10. As a result, two or more main conveyors can be charged by one feed conveyor.

The embodiment of the apparatus of the present invention shown in FIG. 3 corresponds essentially to the embodiment shown in FIG. 1, although the angle α that designates the oblique positioning of the receiving elements 14 is larger, and the angle β that designates the oblique positioning of the clamps 28 with respect to their circulatory path 30 is smaller, than in the embodiment shown in FIG. 1. This arrangement permits a smaller distance between the feed conveyors 22, 24, but may require a larger distance between the clamps 28.

In the embodiments of the apparatus of the present invention shown in FIGS. 1 and 3, it is also conceivable to precisely arrange the circulatory-path sections 32 in vertical planes 34, which form an acute angle with the movement path 12 of the receiving elements 14, so that the feed direction Z has a component that runs in the conveying direction F. Accordingly, the straight line 42 runs obliquely with respect to the circulatory path 30 and parallel to the receiving-element plane 18. In other words, the vertical planes 34 do not run perpendicular to the longitudinal direction of the receiving elements 14.

Figure 4:
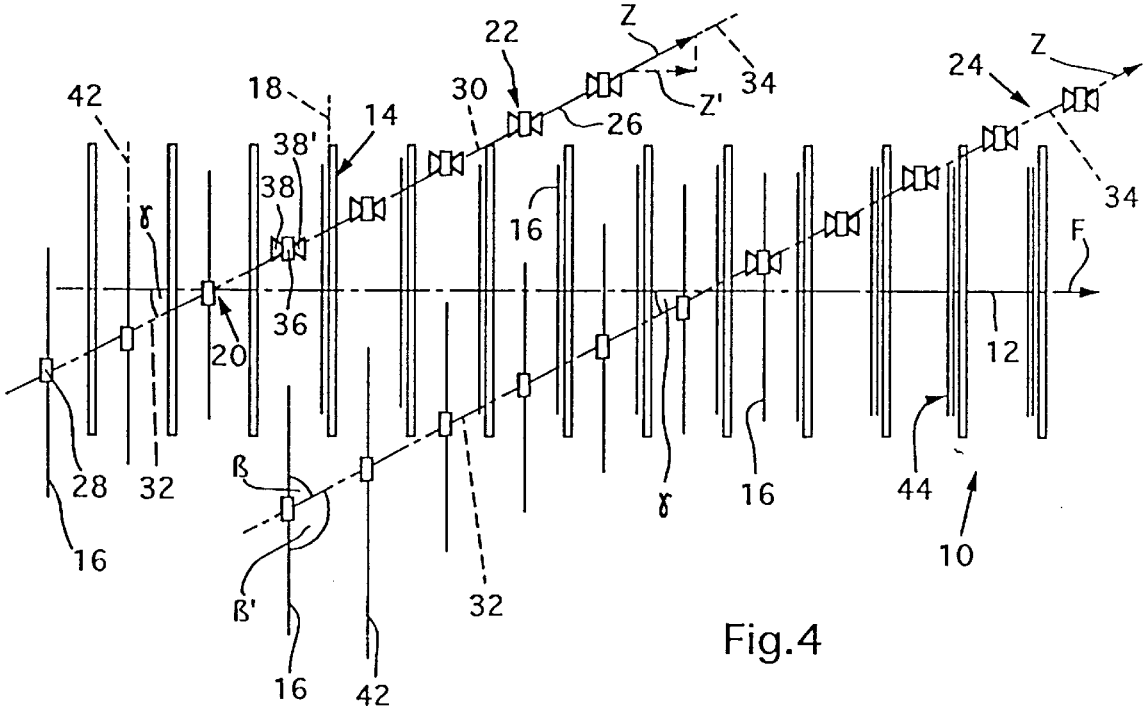
FIG. 4 shows a plan view of an embodiment of the apparatus of the present invention, in which the receiving elements of the main conveyor are arranged perpendicular to their movement path and, at feed locations, two feed conveyors run obliquely over the main conveyor with their clamps being directed parallel to the receiving elements.

In the embodiment of the apparatus of the present invention shown in FIG. 4, the receiving elements 14 are arranged such that their longitudinal direction runs perpendicular to the movement path 12, and thus perpendicular to the conveying direction F. Here too, the receiving elements 14, which are spaced apart one behind the other, are driven in the conveying direction F at a certain conveying speed. The receiving-element plane is designated by 18.

At two feed locations 20, which are spaced apart from one another in the conveying direction F, the circulatory path 30 of each feed conveyor 22, 24 runs over the main conveyor 10. The circulatory paths 30 have their circulatory-path section 32, which is arranged directly upstream of the feed locations 20, running in vertical planes 34 that form an acute angle with the movement path 12 and the conveying direction F. The feed direction Z is selected so that it has a component Z' that is directed in the conveying direction F. This component results in the transfer of the products 16 fed by the feed conveyors 22, 24 to the receiving elements 14.

The clamps 28 of the feed conveyors 22, 24 are positioned obliquely with respect to their circulatory paths 30, such that the straight line 42 and the relevant circulatory path 30 form an acute angle β or an obtuse angle β' that is supplementary to the acute angle. The straight line runs parallel to the receiving-element plane 18.

Like the other embodiments described above, the products 16 are introduced into the receiving elements 14 from the side by the feed conveyors 22, 24 and are transferred to the receiving elements 14 at the feed location 20 by virtue of the clamps 28 being opened. Since each feed conveyor 22, 24 feeds a product 16 to each receiving element 14, the products 16 are combined in the receiving elements to form intermediate products or end products 44. Arranging the receiving elements 14 perpendicular to their movement path 12 makes it possible for the distance between the receiving elements 14 to be small. Of course, the distance between the clamps 28 and the feed rates of the clamps are coordinated with the distance between the receiving elements 14 and the conveying speeds of the receiving elements. Here too, the circulatory path 30 may run over the main conveyor 10 in a horizontal direction or the circulatory-path section 32 may slope toward the feed location 20.

Figure 5:
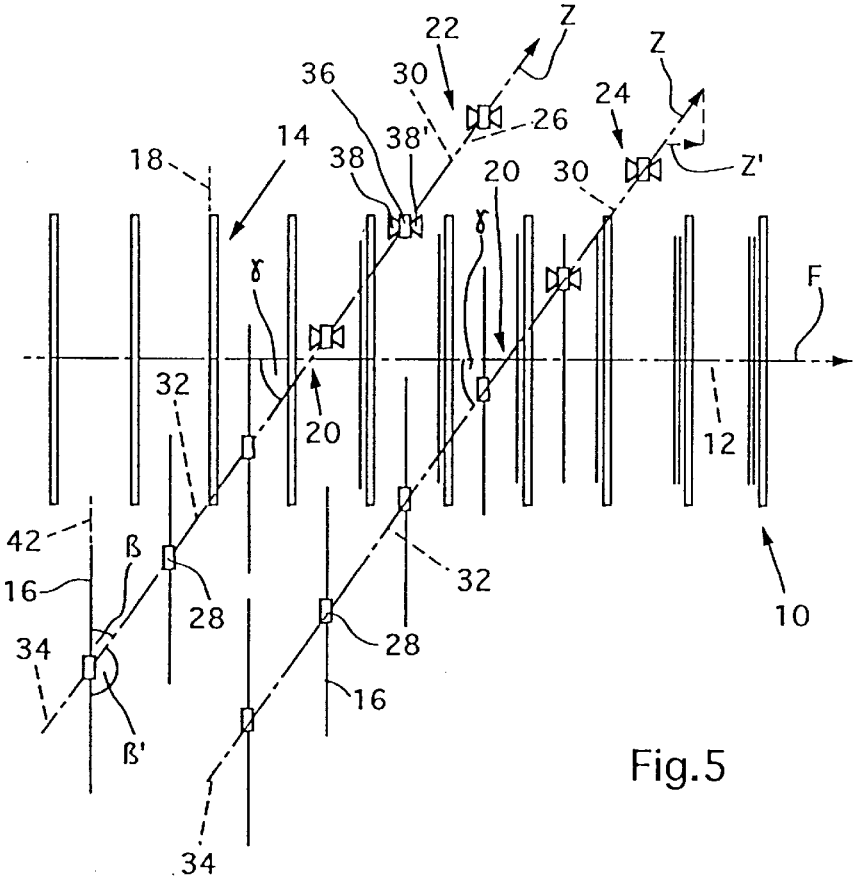
FIG. 5 shows a plan view of a further embodiment of the apparatus of the present invention, in which the receiving elements of the main conveyor run perpendicular to their movement path and the feed conveyors run over the main conveyor at an acute angle that is larger than in the embodiment shown in FIG. 4.

In the embodiment of the apparatus of the present invention shown in FIG. 5, the main conveyor 10 is of the same design as in the embodiment shown in FIG. 4. However, the angle that is formed between the vertical planes 34 and the movement path 12 is larger than in the embodiment shown in FIG. 4. If the same distance is maintained between the receiving elements 14, the distance between the clamps 28 of the feed conveyors 22, 24 is correspondingly larger than in the feed conveyors 22, 24 of the embodiment shown in FIG. 4. Also, in the embodiment shown in FIG. 5, the clamps 28 are positioned obliquely with respect to their circulatory path 30 by the angle β, with the result that the straight line 42 once again runs parallel to the receiving-element plane 18. The introduction of the fed products 16 into the receiving elements 14 and the transfer operation take place in the same way as in the exemplary embodiments shown above.

FIG. 6 shows, in plan view, an embodiment of the apparatus of the present invention whose main conveyor 10 has a stationary receiving element 14 along which the fed products 16 are transported in the conveying direction F by conveying elements (i.e. carry-along protrusions). The circulatory paths 30 of two feed conveyors 22, 24 pass over the receiving element 14 at feed locations 20 that are spaced apart from one another in the longitudinal direction of the receiving element 14. The circulatory-path section 32 of each feed conveyor 22, 24 is arranged directly upstream of the feed locations 20 and runs in a vertical plane 34 that forms an acute angle with the longitudinal direction of the receiving element 14. The feed direction Z is, once again, selected such that it has a component Z' that runs in the conveying direction F. In the circulatory-path section 32, the clamps 28 that retain the products 16 which are to be fed to the main conveyor 10 are positioned obliquely with respect to the circulatory path 30, such that the straight line 42 and the circulatory path 30 form an acute angle β, and the straight line runs parallel to the receiving-element plane 18.

The clamps 28 of the feed conveyor 22 transfer a product 16 to the receiving element 14 at the corresponding feed location 20, and the product is then transported in the conveying direction F. This product 16 is then combined, at the feed location 20 of the other feed conveyor 24, with a further product 16 that is fed by the other feed conveyor 24. The combined products form an intermediate product or end product 44 that is transported further in the conveying direction F to a removal location. The circulatory-path section 32 preferably slopes toward the feed location 20, particularly when the main conveyor 10 is designed for the purpose of collecting the products 16.

In the embodiment of the apparatus of the present invention shown in FIG. 7, the main conveyor 10 has a plurality of parallel receiving elements 14 that are arranged in a drum-like manner around a common axis of rotation 54 and are driven in circulation around this axis of rotation 54 in a circulating direction U. Each receiving element 14 is assigned a conveyor that is well-known in the prior art to transport those products 16 that are fed to the relevant receiving elements in a conveying direction F along the receiving elements 14. With respect to the direction of the axis of rotation 54, three spaced-apart feed locations 20 are provided above the main conveyor 10. The circulatory path 30 of corresponding feed conveyors 22, 24, 24' runs past these feed locations in a rectilinear manner. The circulatory-path sections 32, which are arranged directly upstream of the feed locations 20, run in parallel vertical planes 34 that form an acute angle with the longitudinal direction of the receiving elements 14. The clamps 28 are positioned obliquely with respect to their circulatory path 30, such that the straight line 42 runs parallel to the receiving-element planes 18. The receiving-element planes 18 are defined by the receiving elements 14, and form an acute angle β with the circulatory path 30. Like the other embodiments, the clamps 28 are intended for retaining the products 16 in a suspended state and for discharging them to the receiving elements 14 at the feed locations 20 by virtue of the clamps being opened.

The distance between the clamps 28 is coordinated with the distance between the receiving elements 14, and the circulating speed of the receiving elements 14 corresponds at least approximately to the feed rate of the feed conveyors 22, 24, 24'. This ensures that each receiving element 14 which runs past the feed locations 20 is fed a product 16 by each feed conveyor 22, 24, 24'. Dashed lines indicate that during one revolution of the receiving elements 14 around the axis of rotation 54, the products 16 fed by the feed conveyor 22 are transported in the conveying direction F to the extent where they are combined with the products 16 that are fed by the next feed conveyor 24 during transfer to the receiving elements 14. Similarly, the already combined products are combined with the products 16 that are fed by the next feed conveyor 24'. The main conveyors 10 and their receiving elements 14 that are arranged in a drum-like manner and are suitable for the collation, insertion or collection of products 16, are well-known in the prior art. The embodiment of the feed conveyors 22, 24, 24' shown in FIG. 7 makes it possible to transfer the products to the receiving elements 14 with the conveyor already moving in the conveying direction F as the products are received.

Figure 9:
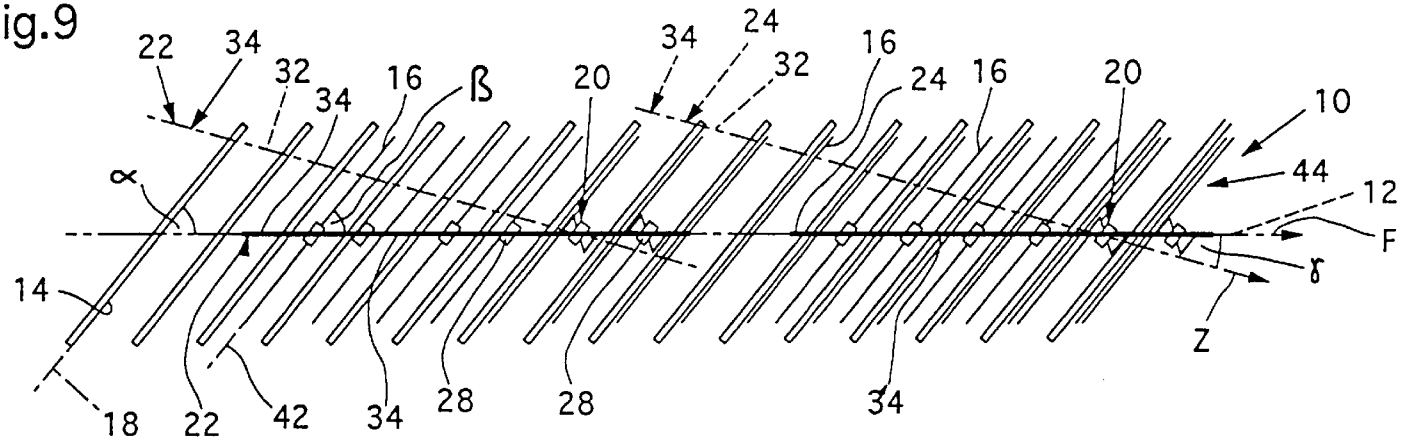
FIG. 9 shows a plan view of the embodiment of the rectilinear section shown in FIG. 8.

FIG. 8 shows a perspective view of an embodiment of the main conveyor 10 of the apparatus of the present invention with cross-sectionally L-shaped receiving elements 14. These receiving elements are fastened on carriages (not shown) that are well-known in the prior art and are guided in a cross-sectionally C-shaped rail 46. A conveying chain 48 (indicated by chain-dotted lines) runs in the rail 46. The conveying chain is connected to the carriages and is driven in the conveying direction F. As also shown in FIG. 9, the receiving elements 14 are positioned obliquely, by the angle α, with respect to their movement path 12, which is defined by the rail 46 (compare FIGS. 1 and 2 in this respect). The rearwardly inclined wall 50, with respect to the conveying direction F, of the receiving elements 14 defines the receiving-element plane 18. At its bottom end, the wall 50 is adjoined by a base 52 that projects forward in the conveying direction F from the wall 50.

The circulatory path 30 (indicated by chain-dotted lines) of the clamps 28 of the feed conveyors 22, 24 has a circulatory-path section 32 that is arranged directly upstream of the feed locations 20. The clamps 28 in the circulatory-path section 32 are spaced apart by a distance corresponding to the distance between the receiving elements 14, and are positioned obliquely with respect to their circulatory path 30, such that the straight line 42 runs parallel to the receiving-element plane 18. Furthermore, the circulatory-path section 32 slopes toward the feed locations 20, with the result that the products 16 that are retained by the clamps 28 are introduced into the receiving elements 14 from above.

As shown in FIG. 9 by a solid line, the circulatory-path section 32 may run in a vertical plane 34 in which the movement path 12 of the receiving elements 14 also runs. As indicated by chain-dotted lines, the vertical planes 34 may also, however, be positioned obliquely with respect to the movement path 12 by the angle γ. In this embodiment, the products 16 which are to be fed are introduced into the receiving elements 14 from above and, at the same time, from the side. Of course, the distance between the clamps 28 is adapted to the distance between the receiving elements 14 in dependence on the oblique positioning of the vertical plane 34.

As best shown in FIG. 8, once the clamps 28 have been opened, the products 16 slide along the wall 50 or a product already present in the relevant receiving element 14, onto the base 52, and then come to rest flatly against the wall 50 or the already present product. This allows products 16 to be collated to form an intermediate product or end product 44.

Of course, it is also conceivable for a folded product 16 to be kept open in a correspondingly designed receiving element 14 and for the products 16 that are fed by the feed conveyors 22, 24 to be inserted into the open product. It should also be mentioned that folded products 16 can be held by the fold during the feeding operation and can be opened before their introduction into the receiving elements 14. As a result, they are deposited and collected in a straddling manner on saddle-like receiving elements 14. For example, the top border of the wall 50 of the receiving elements 14 shown in FIG. 8 may serve as the saddle-like receiving element.

FIGS. 10 and 11 show a region of a feed conveyor 22 where the products 16 are received by the clamps 28. The circulatory path 30 of the clamps 28 runs around a drive wheel 56 that drives the drawing member 26 in the feed direction Z. The clamps 28 are spaced apart from one another on the drawing member 26 such that the straight line 42 and the circulatory path 30 form an acute angle β or an obtuse angle β' that is supplementary to the acute angle. A vertically running receiving section 58, which is arranged downstream of the drive wheel 56, runs past a receiving location 60. The products 16 are fed to the receiving location 60 by a belt conveyor 62, which is arranged with a transverse inclination that corresponds to the oblique positioning of the clamps 28. The conveying strand of the belt conveyor 62 thus runs parallel to the straight line 42 and the clamp mouth 40. Running along the bottom border of the belt conveyor 62 is a supporting belt 64 that is likewise driven in circulation. The bottom side edge 66 of the products that bear on the belt conveyor 62, rest against the supporting belt 64. The products 16 bear on the belt conveyor 62 in an imbricated formation S in which each product 16 bears on the following product.

The respectively foremost product 16 of the imbricated formation S (with respect to the direction A) is introduced into the open clamp mouth 40 of the clamp 28 running past the receiving location 60. The clamp 28 is then closed, and the retained product 16 is raised upward from the following product 16. The leading edge of the following product 16 is then exposed, with the result that it can be introduced into the clamp mouth 40 of the next clamp 28.

The angle β may differ within wide limits but preferably is between 10° and 80°, and more preferably is between 30° and 60°. The oblique positioning of the clamps of the feed conveyor with respect to their circulatory path permits, with different arrangements of the feed conveyor with respect to the main conveyor, accompanying transfer of the products from the feed conveyor to the receiving elements of the main conveyor. As a result, it is possible for the forces acting on the products to be introduced into the receiving elements of the main conveyor in optimum fashion during transfer, for example, as a result of the change in direction of the movement of the products.

When products are combined, preferably at least two products are fed to a receiving element, of which at least one product is fed to the main conveyor by a feed conveyor of the type shown and described above.

Depending on the required combining of products, a plurality of feed conveyors of the above described type may be provided, although not every feed conveyor has to discharge a product to the main conveyor in every operating cycle of the main conveyor. In this situation, the discharge operation is controlled, for example, so that not every clamp is provided with a product, a clamp that is provided with a product is not opened at the feed location, or the relevant feed conveyor is not driven continuously. Products that are not discharged at a feed location may, if appropriate, be fed to a further main conveyor.

Those skilled in the art to which the invention pertains may make modifications and other embodiments employing the principles of this invention without departing from its spirit or essential characteristics, particularly upon considering the foregoing teachings. The described embodiments are to be considered in all respects only as illustrative and not restrictive and the scope of the invention is, therefore, indicated by the appended claims rather than by the foregoing description. Consequently, while the invention has been described with reference to particular embodiments, modifications of structure, sequence, materials and the like would be apparent to those skilled in the art, yet still fall within the scope of the invention.

I claim:

1. An apparatus for processing sheet-like products comprising:

at least one main conveyor that runs past a feed location, the main conveyor having an elongate receiving element to which a product can be fed at the feed location, the receiving element defining a receiving-element plane for the product;

a feed conveyor with a plurality of clamps that are arranged one behind the other, each clamp having a clamp mouth defining a clamp-mouth plane, the clamps being moved in a feed direction along a continuous circulatory path running past the feed location to convey products up to the feed location and to discharge products at the feed location to the receiving element, the circulatory path having a circulatory-path section arranged directly upstream of the feed location;

wherein the clamps are arranged at the feed location and in the section of the circulatory path obliquely with respect to the circulatory path such that the angle that is formed by the circulatory path and a straight line running parallel to the clamp-mouth plane, perpendicular to a longitudinal direction of the clamp mouth, and at least approximately parallel to the receiving-element plane, is respectively one of acute and obtuse.

2. The apparatus as claimed in claim 1, wherein the clamps in the section of the circulatory-path are spaced apart by a predetermined distance and are moved continuously, in the feed direction, through the section of the circulatory path and past the feed location.

3. The apparatus as claimed in claim 2, wherein the section of the circulatory path is arranged above the main conveyor, and the clamp mouth in the section of the circulatory path is directed downward in order to feed the products in a suspended state to the main conveyor.

4. The apparatus as claimed in claim 2, wherein the main conveyor has a plurality of receiving elements that are arranged one behind the other, with respect to the conveying direction, and are arranged obliquely with respect to their common movement path.

5. The apparatus as claimed in claim 2, wherein the section of the circulatory path runs in a vertical plane that is arranged one of perpendicular and obliquely with respect to a movement path of the main conveyor.

6. The apparatus as claimed in claim 5, wherein the vertical plane runs obliquely with respect to the movement path and the feed direction has a component that is oriented in the conveying direction.

7. The apparatus as claimed in claim 5, wherein a leading edge, with respect to the feed direction, of the products retained by the clamps follows behind, with respect to the conveying direction, a trailing edge of the products that is located opposite the leading edge.

8. The apparatus as claimed in claim 6, wherein a leading edge, with respect to the feed direction, of the products retained by the clamps follows behind, with respect to the conveying direction, a trailing edge of the products that is located opposite the leading edge.

9. The apparatus as claimed in claim 2, wherein the main conveyor has a plurality of receiving elements that are arranged one behind the other, with respect to the conveying direction, and arranged perpendicular to their common movement path.

10. The apparatus as claimed in claim 9, wherein the section of the circulatory path runs in a vertical plane that is arranged obliquely with respect to a movement path of the main conveyor, and the feed direction has a component that is oriented in the conveying direction.

11. The apparatus as claimed in claim 2, wherein the receiving element is arranged in the conveying direction, the section of the circulatory path runs in a vertical plane that is arranged obliquely with respect to the conveying direction, and the feed direction has a component that runs in the conveying direction.

12. The apparatus as claimed in claim 11, wherein the main conveyor has a plurality of receiving elements that are arranged in a drum-like manner to rotate around a common axis.

13. The apparatus as claimed in claim 1, wherein the section of the circulatory path is arranged above the main conveyor, and the clamp mouth in the section of the circulatory path is directed downward in order to feed the products in a suspended state to the main conveyor.

14. The apparatus as claimed in claim 1, wherein the main conveyor has a plurality of receiving elements that are arranged one behind the other, with respect to the conveying direction, and are arranged obliquely with respect to their common movement path.

15. The apparatus as claimed in claim 14, wherein the section of the circulatory path runs in a vertical plane that is arranged one of perpendicular and obliquely with respect to a movement path of the main conveyor.

16. The apparatus as claimed in claim 15, wherein the vertical plane runs obliquely with respect to the movement path, and the feed direction has a component that is oriented in the conveying direction.

17. The apparatus as claimed in claim 15, wherein a leading edge, with respect to the feed direction, of the products retained by the clamps follows behind, with respect to the conveying direction, a trailing edge of the products that is located opposite the leading edge.

18. The apparatus as claimed in claim 16, wherein a leading edge, with respect to the feed direction, of the products retained by the clamps follows behind, with respect to the conveying direction, a trailing edge of the products that is located opposite the leading edge.

19. The apparatus as claimed in claim 1, wherein the section of the circulatory path runs in a vertical plane that is arranged one of perpendicular and obliquely with respect to a movement path of the main conveyor.

20. The apparatus as claimed in claim 19, wherein the vertical plane runs obliquely with respect to the movement path and the feed direction has a component that is oriented in the conveying direction.

21. The apparatus as claimed in claim 19, wherein a leading edge, with respect to the feed direction, of the products retained by the clamps follows behind, with respect to the conveying direction, a trailing edge of the products that is located opposite the leading edge.

22. The apparatus as claimed in claim 20, wherein a leading edge, with respect to the feed direction, of the products retained by the clamps follows behind, with respect to the conveying direction, a trailing edge of the products that is located opposite the leading edge.

23. The apparatus as claimed in claim 1, wherein the main conveyor has a plurality of receiving elements that are arranged one behind the other, with respect to the conveying direction, and are arranged perpendicular to their common movement path.

24. The apparatus as claimed in claim 23, wherein the section of the circulatory path runs in a vertical plane that is arranged obliquely with respect to a movement path of the main conveyor, and the feed direction has a component that is oriented in the conveying direction.

25. The apparatus as claimed in claim 1, wherein the receiving element is arranged in the conveying direction, the section of the circulatory path runs in a vertical plane that is arranged obliquely with respect to the conveying direction, and the feed direction has a component that runs in the conveying direction.

26. The apparatus as claimed in claim 25, wherein the main conveyor has a plurality of receiving elements that are arranged in a drum-like manner to rotate around a common axis.

* * * * *

UNITED STATES PATENT AND TRADEMARK OFFICE

CERTIFICATE OF CORRECTION

PATENT NO. : 5,992,840

DATED : November 30, 1999

INVENTOR(S) : Jacques Meier

It is certified that error appears in the above-identified patent and that said Letters Patent is hereby corrected as shown below:

Title page,
References Cited, U.S. Patent Documents, change "5,007,627" to -- 5,007,624 --.

Claim 5, Col. 9, line 30, delete "one of".

Claim 15, Col. 10, line 11, delete "one of".

Claim 19, Col. 10, line 30, delete "one of".

Signed and Sealed this

Fourth Day of July, 2000

*Attest:*

Q. TODD DICKINSON

*Attesting Officer*

*Director of Patents and Trademarks*